US006494674B1

(12) United States Patent
Cameron

(10) Patent No.: US 6,494,674 B1
(45) Date of Patent: Dec. 17, 2002

(54) PORTABLE SUBMERSIBLE LIQUID PUMP ATTACHMENT

(75) Inventor: Jimmy D. Cameron, Alamogordo, NM (US)

(73) Assignee: Sandy Ochoa, Alamogordo, NM (US)

( * ) Notice: Subject to any disclaimer, the term of this patent is extended or adjusted under 35 U.S.C. 154(b) by 0 days.

(21) Appl. No.: 09/718,288

(22) Filed: Nov. 21, 2000

Related U.S. Application Data

(60) Provisional application No. 60/166,862, filed on Nov. 22, 1999.

(51) Int. Cl.[7] ..... F01D 15/12; F01D 25/00

(52) U.S. Cl. ..... 415/124.2; 415/1; 415/232

(58) Field of Search ..... 415/121.1, 121.2, 415/121.3, 124.2, 124.1, 216.1, 122.1; 417/234; 416/244 R, 204 R, 247 R

(56) References Cited

U.S. PATENT DOCUMENTS

| | | | | | |
|---|---|---|---|---|---|
| 2,643,615 | A | * | 6/1953 | Murphy et al. | 415/121.2 |
| 2,736,606 | A | * | 2/1956 | Kmiotek | 239/351 |
| 3,088,416 | A | * | 5/1963 | Danis | 415/132 |
| 3,308,764 | A | * | 3/1967 | Walker | 415/132 |
| 3,785,752 | A | * | 1/1974 | Crespo | 417/319 |
| 3,866,396 | A | | 2/1975 | Meyer | |
| 3,885,885 | A | * | 5/1975 | Cross, Jr. | 415/124.2 |
| 4,404,706 | A | * | 9/1983 | Loyd | 15/344 |
| 4,779,404 | A | | 10/1988 | Bell | |
| 5,148,992 | A | * | 9/1992 | Morrow | 239/289 |
| 5,305,585 | A | | 4/1994 | Cousineau | |
| 5,491,963 | A | | 2/1996 | Jerez | 56/17.1 |
| 5,644,844 | A | | 7/1997 | Pink | |
| 5,651,418 | A | | 7/1997 | Jerez | 172/14 |
| 5,833,434 | A | | 11/1998 | Stahle | |
| 5,836,227 | A | | 11/1998 | Dees, Jr. et al. | |
| 5,894,630 | A | * | 4/1999 | Bitner et al. | 15/330 |
| 6,071,072 | A | | 6/2000 | Chang | |
| 6,247,539 | B1 | | 6/2001 | Jerez | 172/41 |

OTHER PUBLICATIONS

Homelite Operator's Manual P/N PS02218 First Edition Copyright 1999 John Deere Consumer Products, Inc.

* cited by examiner

*Primary Examiner*—John E. Ryznic
(74) *Attorney, Agent, or Firm*—Dennis F. Armijo

(57) ABSTRACT

A self priming pump attachment for transfer of liquids, such as water, attached to a rotating driving source. The rotating driving source can be a string trimmer, a drill or similar apparatus for creating a "wand" with the pump attachment on the end for placement into the liquid. The invention is affixed to the rotating driving source which drives an impeller. A drive shaft can also be used. The impeller has a plurality of veins at a optimal pitch which depends on the speed of the driving source, the density of the liquid and the distance of the discharge point from the pump housing. The pump housing encloses the impeller and contains apertures on a lower portion for drawing in the liquid, and an exit aperture on a top portion for discharging the liquid. Tubing can be affixed to the exit aperture for discharging the liquid at a desired location.

12 Claims, 3 Drawing Sheets

PORTABLE SUBMERSIBLE LIQUID PUMP ATTACHMENT

CROSS-REFERENCE TO RELATED APPLICATIONS

This application is based on U.S. Provisional Application Ser. No. 60/166,862 entitled "Baling (sic) Pump, Hand Held, Gasoline Engine Powered For Removal of Nuisance Water From Work Areas" filed on Nov. 22, 1999, the teachings of which are incorporated herein by reference.

BACKGROUND OF THE INVENTION

1. Field of the Invention (Technical Field)

The invention relates to submersible pumps and more particularly to submersible liquid pump attachments for attaching to a rotating driving source such as a string trimmer.

2. Background Art

Traditionally, submersible pumps for removing or transferring liquids such as water or the like, are self contained units. These pumps contain the drive source in the pump housing. Therefore, the housing for the drive source must be waterproof. This increases the cost and complexity of a submersible pump. Other types of pumping mechanisms utilize centrifugal pumps with a hose or tubular attachment which is placed in the liquid for liquid transfer. U.S. Pat. No. 5,305,585 to Cousineau and U.S. Pat. No. 4,779,404 to Bell, illustrate this. These types of pumps are also expensive and bulky for use on small projects. The present invention solves these problems with a pump attachment for any type of rotating drive source such as a string trimmer. The present invention is an attachment in addition to attachments presently available for string trimmers as shown in Homelite® operators manual, P/N PS02218. A user can simply connect the pump attachment to a string trimmer, place the pump housing in the liquid to be transferred, and start the trimmer.

SUMMARY OF THE INVENTION (DISCLOSURE OF THE INVENTION)

A submersible pump for transfer or removal of a liquid as an attachment to a rotating drive source is disclosed. The most significant novelty of this particular pump in its preferred embodiment is its ability to attach to a string driven trimmer, thus making it portable and versatile for a variety of liquid transfer and/or removal operations. Though this is the preferred embodiment of this pump, it will also work with other rotary driven appliances as an after market attachment.

The preferred pump attachment comprises a connector to connect the drive source to an axle for driving an impeller. The impeller is housed within a pump body and draws the liquid into the pump body, through the impeller and expels the liquid out of the pump body through an outlet tube. A screen or apertures in an inflow plate can be used to filter particulates and keep them from entering the pump body. The connector can have an extension for ease of use and the extension can be curved or angled to for placement of the pump head in the liquid in difficult situations. The pump attachment can be used with other rotating drive sources such as an electric or battery powered drill.

Because the pump housing and its internal working parts can be directly submerged into the liquid, it requires no pre-priming. Further, because the drive mechanism is in a remote location from the liquid it eliminates the costly construction of submersible motors and engines, while at the same time allowing for the safe and effective priming and transfer of the liquid in question.

In the preferred embodiment the invention connects to the end of a "wand" as a fixed extension to the drive mechanism of a weed trimmer. The unit can be hand held and its position manipulated to draw the liquid from any desired position. For instance, it can draw from near the top of the liquid's surface and thus avoid slurry or silt that may collect near the bottom of certain bodies of water or containers. It may also draw liquid from near the bottom if so desired, thus allowing for greater pressure and a higher volume of output. The operator can, in a remote location from the liquid, direct the wand with its attached pump accurately in hard to reach areas or cramped spaces.

The pump invention has a unique impeller. The impeller allows that the pump transfers the maximum amount of water, with the greatest efficiency by causing a vortex of maelstrom effect. This is accomplished by its multiple, pitched and enclosed veins. These veins are likewise scalloped or tapered towards the center of its axis thus aiding in its cavitation and vortex effect. Thus, a smaller amount of surface is directly resisted by the liquid because of the cutting action of the reduced and pitched area of the vein. This causes the centrifugal force to take place more freely as the impeller rotates on its axis, thus producing less load on the drive mechanism while at the same time drawing an increased amount of water up and out of the pump housing with greater rpm's and increased suction.

The field of application for such a pump attachment is wide and varied. The fact that it connects to an existing home appliance that is common to many households makes it a practical investment to the professional and home owner alike. It can be used effectively in situations such as flooded boats, pool care, washing machine repair, stagnant water removal, flooded basements, golf course maintenance, flooded water meters, plumbing applications, dairies, farming and ranching applications, fish hatcheries and ponds, nurseries, and virtually any liquid transfer or disposal situation.

A primary object of the present invention is to provide an attachment to a rotating drive source such as a string trimmer for the removal or transfer of a liquid.

Another object of the present invention is to provide a pump that is self priming.

Yet another object of the present invention is to provide a submersible pump where the drive source is not submerged into the liquid to be transferred or removed.

A primary advantage of the present invention is that the pump attachment is less expensive than prior art submersible pumps.

Another advantage of the present invention is its simplicity of design.

Yet another advantage of the present invention is its durability.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

(BEST MODES FOR CARRYING OUT THE INVENTION)

Figure 1:
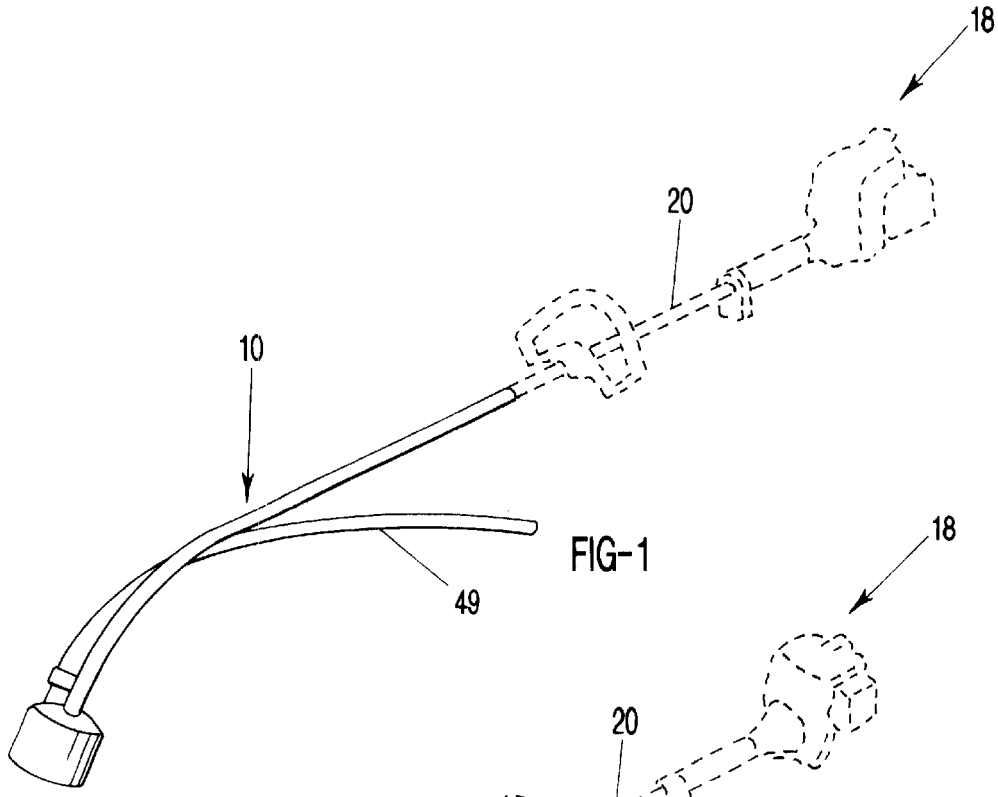
FIG. 1 is a perspective view of the Portable Submersible Liquid Pump Attachment attached to a gas powered string trimmer with a bend in the shaft of approximately 45°.
Figure 2:
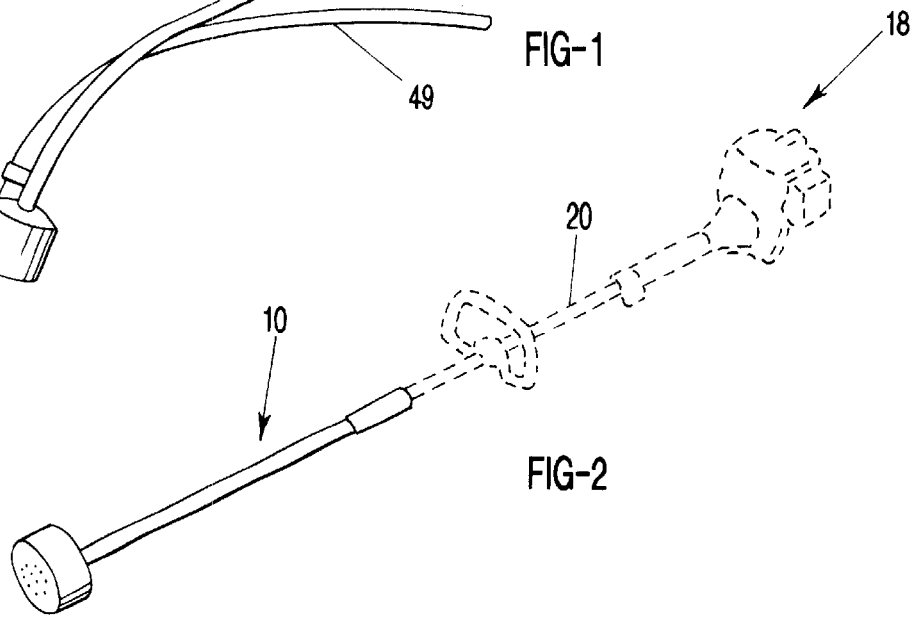
FIG. 2 is a perspective view of the invention as shown in FIG. 1, with a straight shaft.
Figure 3:
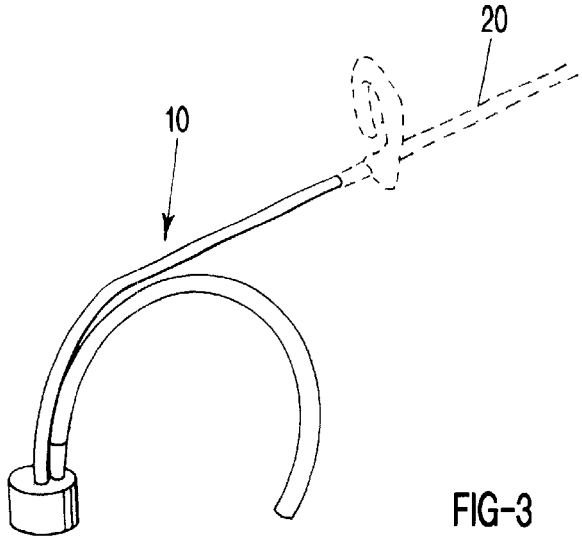
FIG. 3 is a perspective view of the invention as shown in FIG. 1 with the shaft bent at an angle of approximately 90°.

FIGS. 1, 2, and 3 show the pump invention attached to a string trimmer. Although only a gas motor trimmer 18 is shown, the pump attachment 10 can also be attached to an electric motor trimmer. As can be seen from these figures, the pump attachment 10 can be configured at different angles from the driving stem 20 of the motor trimmer 18.

Figure 4:
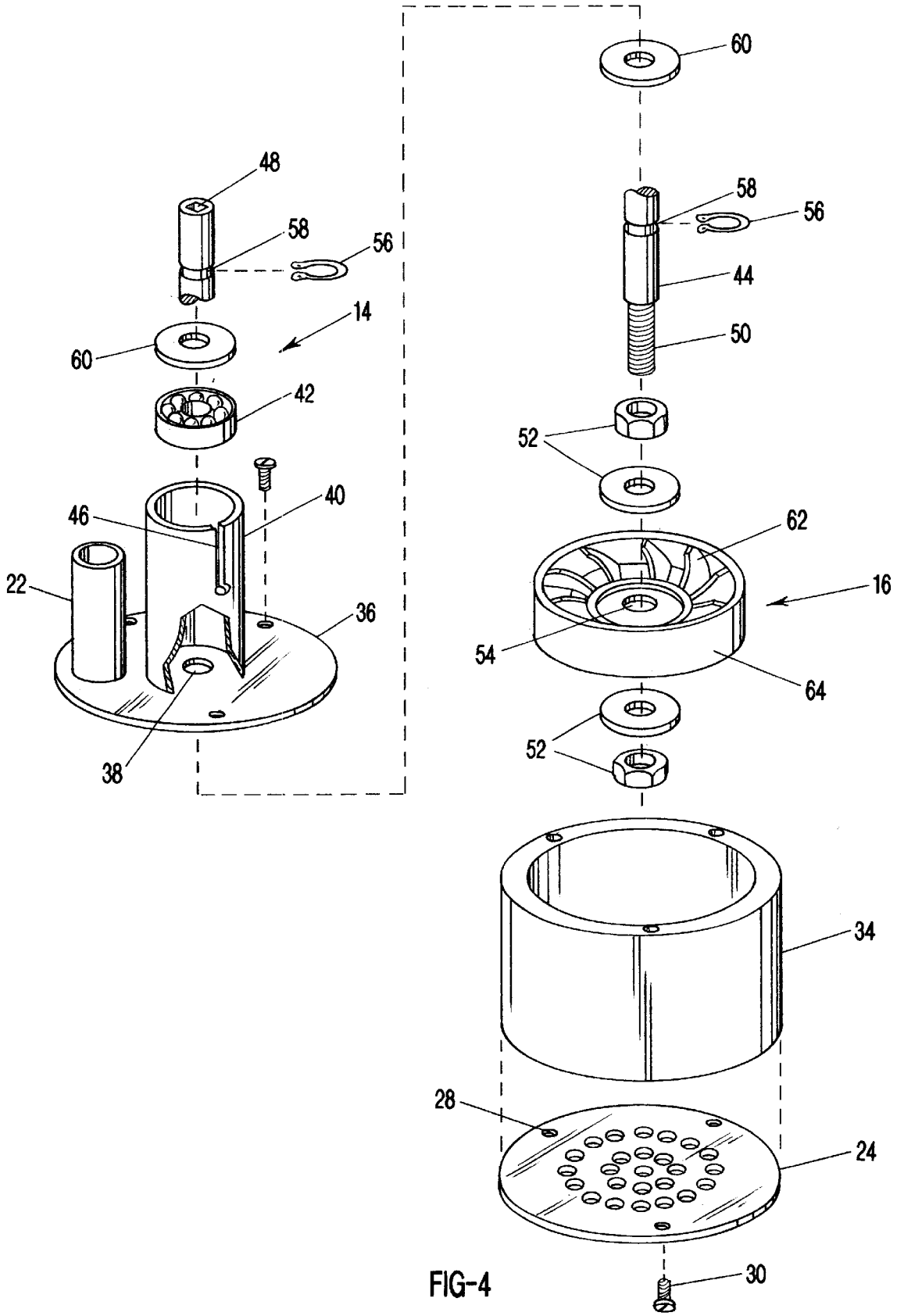
FIG. 4 is an exploded view of the preferred pump attachment.

Referring to FIG. 4, the pump attachment consists of three major assemblies that make up its preferred embodiment, those assemblies consist of a pump housing assembly 12, a coupling and axle assembly 14, and the impeller 16.

The pump housing is shown in FIGS. 5, 6, 7, and 8. The purpose of the pump housing 12 provides a vessel or housing through which the liquid can be drawn in, pressurized, and expelled to an outlet opening 22. In addition, the pump housing 12 provides a means to fasten the pump housing 22 to the trimmer tubing 20 as an exterior part of the drive coupling, and provide a housing for the internal working parts which include the coupling and axle assembly along with the impeller 16.

The first element of the pump housing 12 is its under surface plate 24. This plate 24 provides an intake area for the pump cavity as well as creating its lower enclosure. It is preferably made of a thin (approx. ⅛" thick) round (approx. 3" diam.) flat plate with a series of small holes 26 drilled transversely, through the flat portion, FIG. 8, of the plate. This series of holes 26 preferably begins in the center and in a circular pattern and extends outwards towards the plate's perimeter finally terminating well within its diametric limit. Other hole patterns can be used with the same effect. The only limitation is that the number of holes 26 and size of the holes 26 must be of sufficient area to allow sufficient liquid to flow into the pump housing 12 at an optimally efficient rate. The liquid will be drawn through these holes 26 for the purpose of an intake, and the diameter of the holes can also serve as a strainer of particulates such as gravel or sand that may be drawn in with the liquid. A screen can be used to filter finer particulates, if desired (not shown). At the far edges of the surface plate 24, fastening holes 28 are drilled for screws 30, or the like to affix the plate 24 to the under surface of the pump housing 32.

The next portion of pump housing 12 is pump housing body 34 as shown in FIG. 4. It preferably consists of a cylindrical, tubular portion of the pump housing 12. The pump housing body 34 forms a cavity through which the liquid is drawn in from the under surface plate 24, drawn through its tubular length to the impeller 16, and pressurized to be expelled through an outlet 22 in the top surface plate 36. The outside tubular diameter of the pump housing body 34 is essentially the same as the outside diameter of the under surface plate 24, so as to accommodate their being aligned and affixed to each other with three screws 30 through holes 28 and screwed into the wall of the pump housing body 34.

Figure 5:
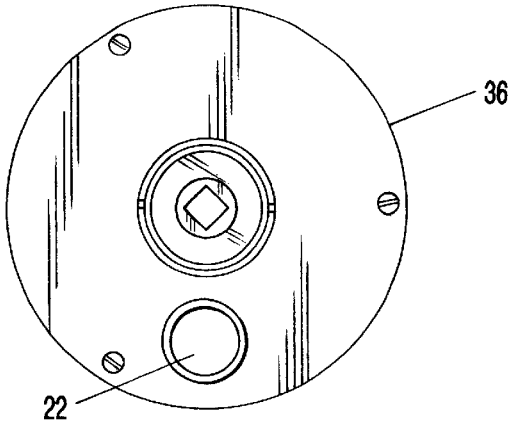
FIG. 5 is a top view of the pump housing.
Figure 6:
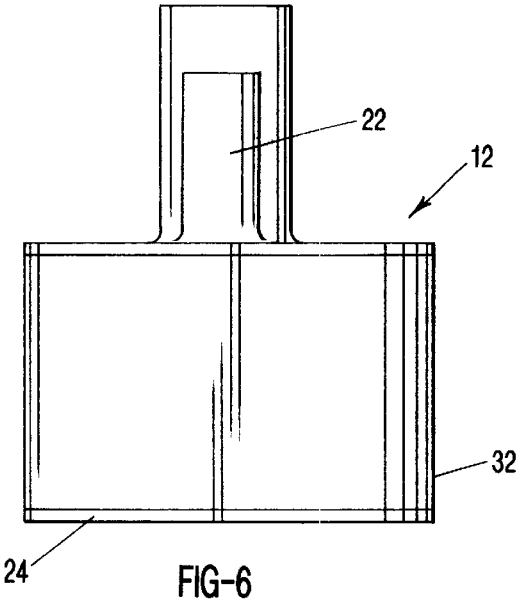
FIG. 6 is a front view of the pump housing.
Figure 7:
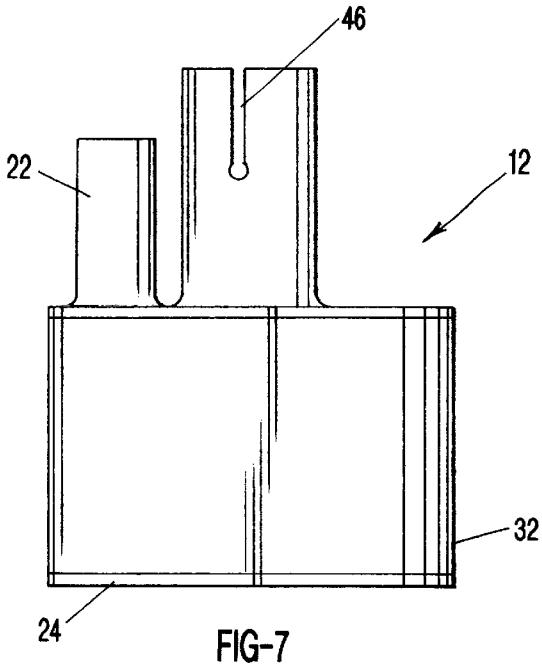
FIG. 7 is a side view of the pump housing.
Figure 8:
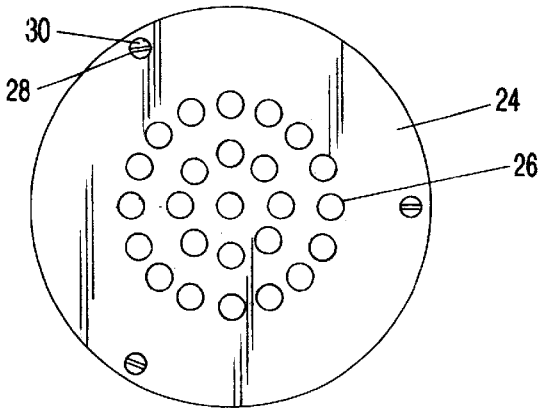
FIG. 8 is a bottom view of the pump housing.

The preferred top surface plate 36 is shown in FIGS. 4 and 5. This portion of the pump housing assembly 12 provides the upper enclosure for the pump housing cavity as well as an aperture for the expulsion 22 of the liquid out of the pump housing cavity to a remote location. It further provides a means by which to affix the pump in its entirety to the string (flexible shaft) driven trimmer. The preferred top surface plate 36 consists of a thin round plate with diametric values that are similar as the under surface plate 24. Top surface plate 36 has a rotating axle hole 38 drilled through its flat center to accommodate the insertion of a rotating axle 44 in the coupling assembly. Also welded in the center of the top plate 36 at a 90 degree angle is a piece of round tubing 40 which is of sufficient inside diameter to house a bearing 42 for the rotating axle 44 as well as a sufficient inside diameter to sleeve the outside dimension of the tubing extension 40 which houses the drive shaft on a weed trimmer (not shown). The inside dimension of this tubing 40 is only slightly oversized in this respect so as to provide a tight fit of close tolerance. The tube 40 is then slotted 46 along its length, half the distance of its overall span. This slot 46 in conjunction with a sufficiently thin wall that will allow flex when the tubing is compressed with an outside clamp, such as a hose clamp, affords it to be securely attached to the flexible shaft tube extension that is a standard part of the weed trimmer (not shown). The top plate 36 further has an outlet aperture for expulsion of the liquid after pressurization in the pump housing cavity. An outlet tubing 22 is then affixed, preferably by welding, to the top plate 36 after having its inside diameter aligned in relationship to the aforementioned outlet aperture. A flexible hose or tubing 48 may be affixed in order to pump the pressurized liquid to a remote location, as shown in FIG. 1. As with the bottom plate 24, top plate 36 is affixed to the top of the pump housing body in order to enclose the pump housing cavity and provide a pressurization chamber to house the impeller 16 as it spins on its rotating axle 44. The pump housing 12 can be hard metal, plastic, a combination of both, or other suitable materials. In addition, the physical configuration of the pump housing 12 can be changed without affecting the operation of the pump.

The second major portion of the pump's construction is the axle and coupling assembly 14. The function of this portion of the pump is to couple the flexible, rotating shaft of the weed trimmer to the shaft or rotating axle 44 of the pump mechanism. Further, the purpose of this assembly is to provide a means by which to fasten the impeller 16 to the rotating shaft 44 of the pump. Referring to FIG. 4, a cylindrical axle 44 of appropriate diameter so as to fit within the dimensions of the centered hole 38 on the top plate 36 of the pump housing 12 is the means to fasten and turn impeller 16. This axle 44 is of appropriate length as well, so as to fit within the dimensional limits of the pump housing 12. The axle 44 is constructed so as to have an inner key way or square tube cavity 48 within its top portion that couples to the flexible shaft of a weed trimmer by means of a male, square, tang, that protrudes as a rotating shaft, which is common to weed trimmers (not shown). The inner key way 48 is slightly oversized in relation to the tang and acts as a receiver for this tang with a fit of nominal tolerance so as to provide a secure and positive coupling between the rotating pump axle 44 and the weed trimmer's flex shaft. The opposing end of the axle 44 is equipped with the appropriate amount of threads 50 so as to accommodate the fixing of the impeller 16 to the axle assembly 14 by means of a nut and washer assembly 52. A nut that has threads to match that of the ones cut into the lower portion of the axle assembly 14, is threaded onto the axle 44 and then an appropriate washer is slipped over this portion of the shaft 44 as well to provide a backing for the fastened impeller 16. Next the impeller 16, the scalloped side of its veins 62 toward and at a right angle in relationship to the shaft 44, is slipped onto the threaded side 50 of the axle 44 by means of an impeller hole 54 of appropriate diameter in the center of the impeller 16. Another washer of appropriate size is slipped onto the axle and then another nut is threaded onto the axle 44 and given the appropriate tightness so as to securely fasten the impeller 16 to the top plate 36 of the pump housing 12 by means of two lock rings 66 along with a bearing 42 that provides smooth rotation of the axle assembly 14. Two square shouldered grooves 58 are cut into the axle 44 at appropriately spaced points along the shaft 44. These grooves 58 are cut in line with the rotation of the axle 44 around its circumference to an appropriate depth and width so as to receive the snap rings 56 that will act as keepers for the axle and coupling assembly 14. First the bottom snap ring 56 is set into the groove 58 and a thrust washer 60 with a hole of appropriate size is slipped over the axle 44. Then a bearing 42 of sufficient inside diameter, to receive the axle assembly 14, and appropriate outside diameter, to provide a press fit into the center tube 40 on the top plate 36 of the pump housing 12, is press fit into the inside of the tube 40 until it is seated firmly at the bottom of the tube 40 and against the top flat portion of the top plate 36. Then the axle assembly 14 with the lower snap ring 56 and thrust washer 60 in place is inserted upward through the center hole 38 in the top plate 36 of the pump housing 12 and the inside diameter of the bearing 42 simultaneously as they are aligned with one another. To complete the assembly a top thrust washer 60 is slipped over the axle 44 after which the top snap ring 56 is secured in its respective groove 58. The joining of the coupling and axle assembly 14 is complete and the top plate 36 of the pump housing 12 may now be affixed to the pump housing body 34. As shown in FIGS. 1, 2, and 3, a hose 49 of appropriate length is placed over the outlet tube 22 of the pump housing 12 to remove or transfer liquid to a remote location. The entire assembly 10 is attached via the coupling tube and the square tubular key way in the axle and coupling assembly 14 by inserting these over the matching end of the string drive weed trimmer, finally being secured by the appropriate type of clamp around the outside of the centralized pump housing tube (not shown).

The function of this pump is the unique construction of its impeller 16 as shown in FIG. 4. The impeller 16 is the rotating part of the mechanism, which after coming in contact with the liquid, produces the maelstrom or whirlpool effect, thereby drawing the liquid up from the pump inlet at the bottom plate 24 and expelling it under pressure through its top outlet 22. The veins or blades 62 that come into contact with the liquid are pitched at such an angle so as to cause a cutting or slicing motion through the liquid thereby using a mechanical advantage to lift the water towards the outlet 22 while at the same time decreasing load on the motor of the string trimmer. These veins 62 are likewise tapered so as to narrow as they extend inward towards the center of the axis upon which the impeller 16 spins. This in effect decreases the surface area that contacts the liquid thereby increasing rpm's, and further decreasing the load. The veins 62 have a slight curvature along their surface which further decreases friction and load. These veins 62 are enclosed by an impeller tube 64 that is molded as a single part of their outward extremity, and act as an enclosure opposite the impeller's axis. This acts to create a tunnel effect that contains the liquid more efficiently within the working area of the impeller 16, and eliminating liquid bypass. This intensifies the swirl effect within the pump housing 12 and creates a greater amount of suction on the inlet side and higher amount of pressure on the outlet side, while trapping and moving an increased portion of liquid. The final feature of the impeller 16 is the effect of cavitation that takes place in the top center near its axis. As a result of the tapered veins 62 in conjunction with the impeller tube's 64 tunnel effect, and the lowered frictional construction of the impeller 16 in general, there is a low pressure area that is created near its center. This unique cavitation that is a result of the sum total of the impeller's novel construction creates an unusually strong draw of lower pressure liquid up from the intake side, and an unusually strong output of high pressure liquid on the output side. This creates a pump impeller 16 that can draw an unusually large volume of water, while at the same time producing only a minimal amount of load on the drive motor. This makes for an efficient, yet effective pump mechanism.

The invention can be modified for use with other rotating drive sources such as a hand held drill. The axle can be directly placed in the chuck of the drill for use (not shown).

Although the invention has been described in detail with particular reference to these preferred embodiments, other embodiments can achieve the same results. Variations and modifications of the present invention will be obvious to those skilled in the art, and it is intended to cover in the appended claims all such modifications and equivalents. The entire disclosures of all references, applications, patents, and publications cited above, are hereby incorporated by reference.

What is claimed is:

1. A portable hand held device for converting a string trimmer into a submersible pump, the portable hand held device comprising:

a pump comprising an inlet and an outlet; and an axle comprising a connecting means at a first end of said axle for coupling said axle to an extension, said extension connected to a rotating member of the string trimmer, a second end of said axle connected to a rotating impeller encased in said pump.

2. The invention of claim 1 wherein said inlet comprises a plurality of apertures.

3. The invention of claim 1 wherein said inlet comprises a particulate filter.

4. The invention of claim 1 wherein said extension comprises an angled extension.

5. The invention of claim 1 wherein said impeller comprises a plurality of veins optimally configured to draw liquid into the said housing from said inlet and expelling the liquid through the outlet under pressure.

6. The invention of claim 1 wherein said connecting means comprises a key way for accepting a tang of the string trimmer.

7. The invention of claim 1 wherein said housing comprises:

a bottom plate wherein said inlet comprises a plurality of apertures in said bottom plate, wherein said bottom plate is affixed to a bottom of a cylinder; and a top plate wherein said outlet comprises a tube affixed to said top plate, wherein said top plate is affixed to a top of said cylinder.

8. The invention of claim 1 wherein said housing further comprises an axle aperture and axle bearing.

9. The invention of claim 1 wherein said outlet comprises an outlet tubing for accommodating an extension hose.

10. The invention of claim 1 wherein said connecting means comprises a coupling.

11. A method of converting a string trimmer into a pump, the method comprising:

removing a head from the string trimmer; and connecting a pump to a string trimmer rotating member.

12. The method of claim 11 further comprising attaching an extension between the pump and the string trimmer rotating member.

* * * * *